US009364938B2

(12) United States Patent
Dunwoody

(10) Patent No.: US 9,364,938 B2
(45) Date of Patent: Jun. 14, 2016

(54) APPARATUS FOR HOLDING A CONTAINER

(75) Inventor: Paul Robert Dunwoody, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 156 days.

(21) Appl. No.: 14/006,210

(22) PCT Filed: Mar. 6, 2012

(86) PCT No.: PCT/EP2012/053826
§ 371 (c)(1),
(2), (4) Date: Sep. 19, 2013

(87) PCT Pub. No.: WO2012/126723
PCT Pub. Date: Sep. 27, 2012

(65) Prior Publication Data

US 2014/0008856 A1 Jan. 9, 2014

(30) Foreign Application Priority Data

Mar. 21, 2011 (EP) ..... 11158968

(51) Int. Cl.
*B25B 11/00* (2006.01)
*B21D 51/26* (2006.01)

(52) U.S. Cl.
CPC ..... *B25B 11/005* (2013.01); *B21D 51/26* (2013.01); *B21D 51/2692* (2013.01)

(58) Field of Classification Search
CPC ... B21D 51/26; B21D 51/2692; B25B 11/005
See application file for complete search history.

(56) References Cited

U.S. PATENT DOCUMENTS 3,383,808 A * 5/1968 Deshayes ..... B24B 13/0052 164/112
3,628,451 A * 12/1971 McClellan et al. ..... 101/4
3,833,230 A * 9/1974 Noll ..... B23B 31/307 269/21
4,266,685 A * 5/1981 Lee, Jr. ..... B65D 7/42 220/656
4,316,375 A * 2/1982 Lee, Jr. ..... B65D 7/42 72/105
4,781,047 A * 11/1988 Bressan et al. ..... 72/84
5,348,316 A * 9/1994 Lin ..... H01L 21/6838 228/44.7
5,694,822 A * 12/1997 Maidment ..... 83/114
6,237,388 B1 * 5/2001 McClung ..... B21D 43/05 248/363
2010/0126245 A1 * 5/2010 Frattini ..... 72/422
2012/0167362 A1 * 7/2012 Smith ..... B24B 9/167 29/10
2013/0255453 A1 * 10/2013 Buck ..... B25B 11/005 82/1.11

FOREIGN PATENT DOCUMENTS

EP 0853515 7/1998
EP 2502684 A1 * 9/2012
GB 575923 3/1946
GB 575923 A * 3/1946

(Continued)

*Primary Examiner* — Joseph J Hail
*Assistant Examiner* — Marc Carlson
(74) *Attorney, Agent, or Firm* — Baker & Hostetler LLP

(57) ABSTRACT

The apparatus comprises holder (20) with a seating face on which a container such as a cupshaped article (1) stands. Air is supplied through channels and air pressure is balanced so as to hold the article (1) against the face. The profile of the apparatus guides a base feature, or "stand" of the article (1) into the holder (20) and onto the seating face (23), and contacts the article (1) radially outside the seating face (23). The apparatus also has a concentric outer sleeve (25) to provide the additional radial contact and resist lateral movement of the article (1) while maintaining concentricity.

16 Claims, 3 Drawing Sheets

(56) References Cited

FOREIGN PATENT DOCUMENTS

| | | | | | |
|---|---|---|---|---|---|
| GB | 601485 | 5/1948 | | | |
| GB | 601485 | A | * | 5/1948 | |
| WO | WO 97/12706 | | | 4/1997 | |
| WO | WO 9712706 | A1 | * | 4/1997 | |

* cited by examiner

PRIOR ART

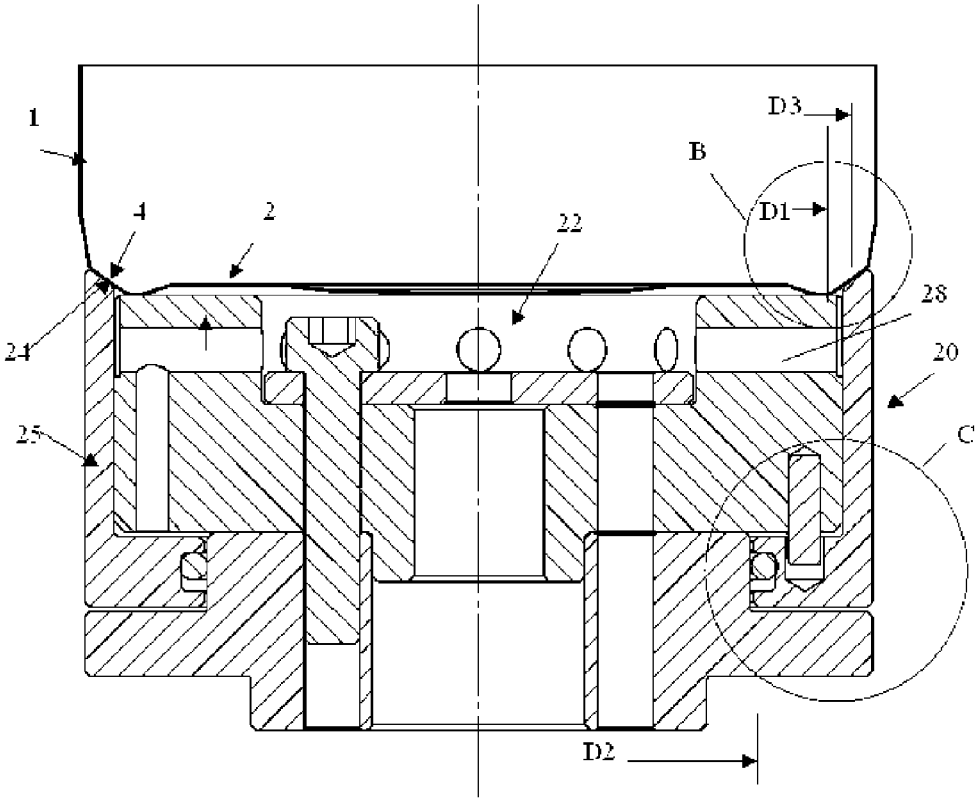
Figure 3
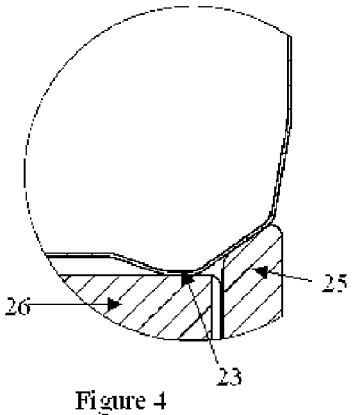
Figure 4
Figure 5
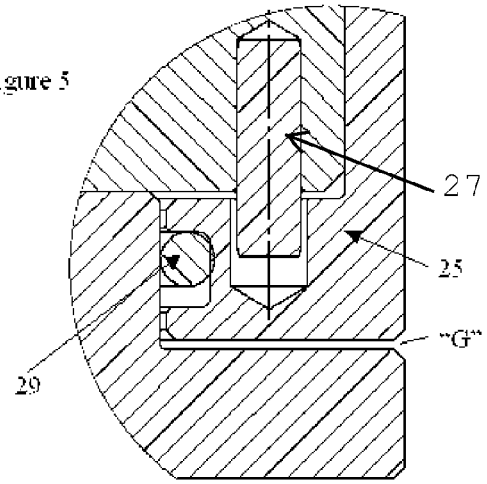

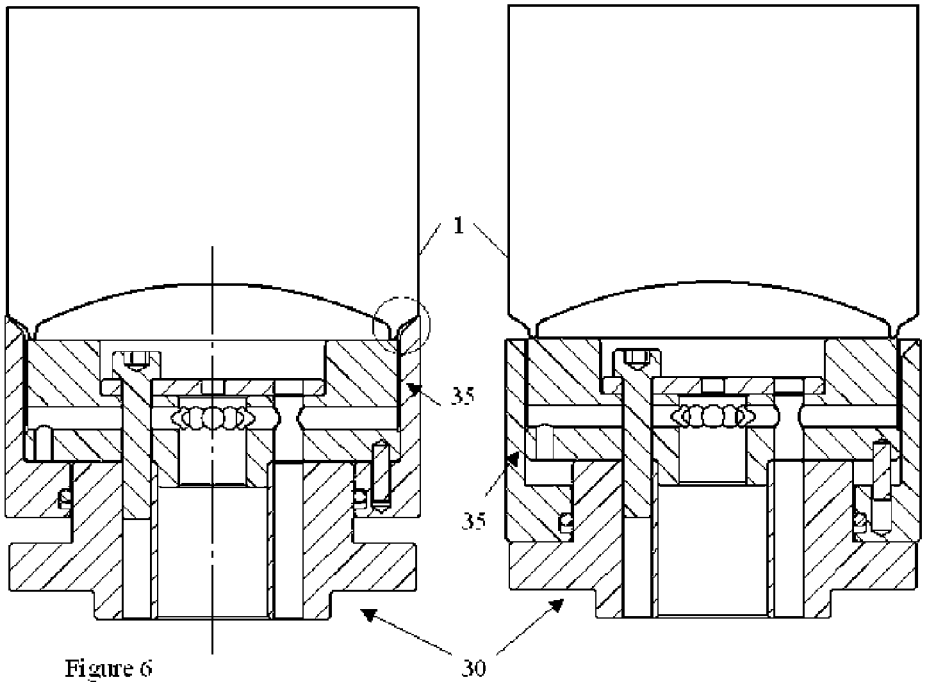
Figure 6
Figure 8
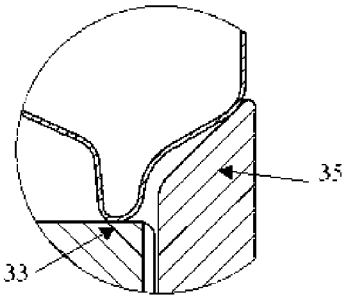
Figure 7

APPARATUS FOR HOLDING A CONTAINER

CROSS-REFERENCE TO RELATED APPLICATIONS

This application is the National Stage of International Application No. PCT/EP2012/053826 filed Mar. 6, 2012, which claims the benefit of EP application number 11158968.5, filed Mar. 21, 2011, the disclosures of which are incorporated herein by reference in their entirety.

TECHNICAL FIELD

This invention relates to an apparatus for holding a container. In particular, but not exclusively, the invention relates to an apparatus and method for holding a container or cup-shaped article such as a metal can body, container lid or closure, whilst performing operations on the sidewall or rim of the container. Examples of such operations include cutting or forming the sidewall or rim of the container or applying a material such as a coating, decoration or lining.

BACKGROUND ART

EP 0853515 B (CROWN CORK & SEAL TECHNOLOGY CORP.) is a blow forming apparatus in which a whole can body is held in a three part movable mould: base, centre and top part while compressed air is introduced to force the can body to conform to the interior profile of the moving mould parts. Whilst this is suitable for forming complex shapes, such shaping requires complex blow forming machinery and is not always be needed for holding a can when carrying out more simple rotational operations.

U.S. Pat. No. 5,694,822 (REYNOLDS METALS COMPANY) describes an apparatus for trimming cylindrical can bodies. The can bodies are successively mounted with vacuum onto a support mandrel so that the open end portion of the can body projects between an outside circular cutting knife and an inside trimming edge. The invention of this patent is said to be less complex than traditional trimmers in which the closed end of the can body is held by vacuum onto a base pad. The base pad of the traditional trimmer comprises a holder which has a flat face and a circular centralising feature. The holder has holes or channels through which negative air pressure or "suction" is applied. This generally allows the can body to be held concentrically and permits rotational operations to be performed accurately in a plane perpendicular to the longitudinal axis of the article.

Although considered by Reynolds to be over-complex, this method of holding can bodies or shallower cup-shaped articles is well suited to high-speed manufacturing equipment. In such equipment, containers are loaded onto and unloaded from holders at high speed. The application of suction is sometimes complemented by the application of small amounts of compressed air when releasing the container.

The base of a container such as a beverage can often has a bead or rim portion known as a stand (bead), which stiffens the container and allows it to rest on a flat surface without rocking. The container is thus be conveniently held rigidly by a holder using suction onto a flat surface and a seal is formed between the surface and the stand.

It is also known to provide a raised feature on the face of the holder, which fits within a recess in the base of the container and provides a circular centralising feature. If there is no suitable recess in the base of the container or cup-shaped article, the centralising feature comprises a raised feature, which fits outside the base of the article. However, machine motion often limits the ability to provide a holder of a larger diameter than the container, which constrains the design of the centralising feature.

Due to the variability in manufacturing processes, it is often necessary to allow a radial clearance between the container or cup-shaped article and the centralising feature. Without this clearance, the container can fail to seat properly on the flat face, and this may impair the seal or cause it to rock on the holder. Unfortunately, this clearance can lead to non-concentrical holding of the container or article and allows sideways/radial movement of the article.

If seal or grip is lost due to improper seating of the container or cup-shaped article, then manufacturing defects can occur. For example, a cutting operation may not cut through the full circumference due to rotation of the container/article on the holder. Sometimes, the cut becomes spiral if the article is lifted away from the holder. If grip is lost in a cap or can flanging or curling operation, an incomplete or uneven flange or curl results. Similarly, if grip is lost in a lining operation, a defective lining is created.

This invention seeks to provide a holder, which addresses these problems. In the following text, which relates to the present patent application, expressions such as "container" or "cup-shaped article" are used interchangeably and are intended to cover a wide variety of items, including lids, closures and metal can bodies. Use of either expression is not intended to be limiting or to exclude equivalents or standard alternatives in the packaging trade.

SUMMARY OF INVENTION

According to the present invention, there is provided an apparatus for holding a container or cup-shaped article, the apparatus comprising a holder including a seating face for contacting a base feature or "stand" on the article, and one or more channels for supplying, removing or balancing air pressure such that when suction is applied to the article, the stand is held against the seating face; and a guide profile for guiding the article into the holder; characterised in that the profile guides the stand onto the seating face and comprises additional contact with the article radially outside the seating face; and in that the apparatus includes a concentric outer sleeve which provides the additional radial contact and resists lateral movement of the article whilst maintaining concentricity, and the sleeve is axially moveable from a position in which the sleeve contacts an outer profile of the article and holds the article concentrically, and a retracted position for release of the article from the seating face.

The sleeve may also include a conical seal and may include a device to prevent rotation, for example in the form of one or more pin(s). In order to provide accurate holding of the article and to avoid wear, it is preferred that the sleeve is of a rigid material.

Generally, the channels may interconnect from the centre of the holding apparatus to regions between the seating face and the sleeve. Further suction channels may be provided to interconnect from the centre of the holder to regions of the holder below the seating face and the outer sleeve.

The apparatus may further comprise an orifice plate, which regulates the flow of air to or from the holder, in particular when no article is present.

According to another aspect of the present invention, there is provided a method of holding a cup-shaped article in a concentric position, the method comprising: supplying, removing or balancing air pressure such that when suction is applied to the article, the article is held against a seating face of a holder; and characterised by: preventing radial movement of the article with a concentric outer sleeve and thereby maintaining concentricity of the article; and moving the outer sleeve into a retracted position and releasing the article from the seating face.

The method may also involve balancing pressure difference between both sides of the article.

A step of supplying compressed air may aid release of the article from the seating face.

Ideally, the method further comprises regulating the flow of air to or from the holder when no article is present.

BRIEF DESCRIPTION OF DRAWINGS

Preferred embodiments of the present invention will now be described, by way of example only, with reference to the drawings, in which:

FIG. 3 is a side view with partial side section of a holding apparatus according to a first embodiment of the invention;

FIG. 4 is enlarged view B of FIG. 3;

FIG. 5 is enlarged view C of FIG. 3;

FIG. 6 is a side view with partial side section of a holding apparatus in a first sleeve position according to a second embodiment of the invention;

FIG. 7 is enlarged view C of FIG. 6; and

FIG. 8 is a side view with partial side section of a holding apparatus in a second sleeve position according to the second embodiment of the invention.

DESCRIPTION OF EMBODIMENTS

Figure 1:
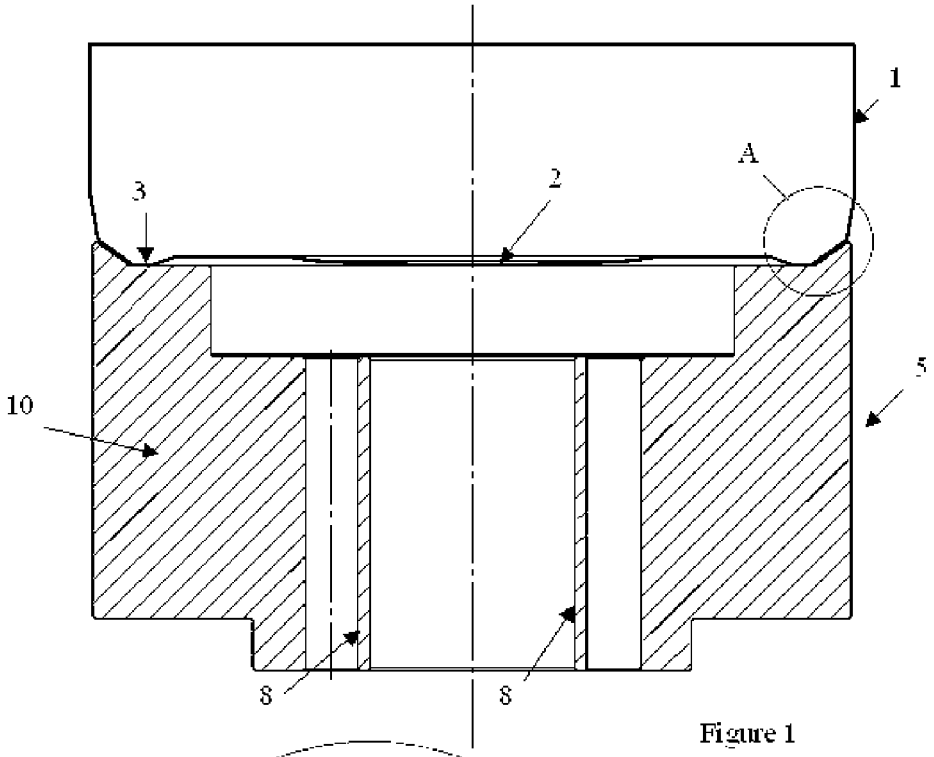
FIG. 1 is a side view of a prior art device for holding a container.

The side view and partial section of FIG. 1 shows a prior art apparatus 5 for holding a container such as a drawn cup 1. The drawing shows a central region and a cross-hatched, sectioned region of holder 10. Detail is omitted from the central region but it can be seen that there are channels 8 which could be used for the passage of air supply and removal, according to requirements of holding the cup on the holding apparatus 5.

The central region serves to accommodate the centre of the cup base 2, and in particular to accommodate any shape, button or protrusion on the cup base 2. If the cup base 2 has a recess, the central region of the holder includes circular centralising feature, comprising a raised feature, which fits inside a recess in the recess and holds the cup concentrically.

Figure 2:
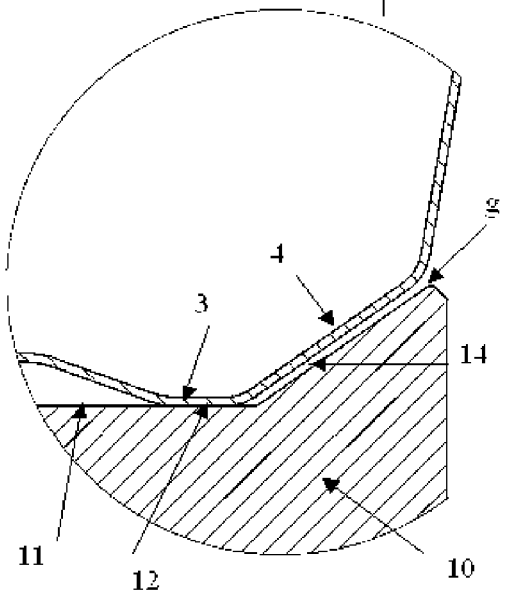
FIG. 2 is enlarged view A of FIG. 1.

The sectioned region 10 of prior art holder 5 includes a support annulus 11, and a seating face 12 at a radially outer part. The seating face 12 contacts a stand 3 of the cup 1 as can be seen more clearly in the enlargement of area A, which is shown in FIG. 2. From the enlarged view A, it is apparent that the stand 3 contacts annular seating face 12 over substantially all of the radial extent of stand bead 3. However, inclined portion 4 of drawn cup 1 is spaced from shoulder region 14 of the sectioned region 10 of holder 5 by a clear gap "g" such that in this prior art example, the conical shoulder region 14 has a guide function only. Gap "g" extends over the conical shoulder region 14 of sectioned region 10, such that radial movement of the cup 1 is possible when not constrained by negative air pressure or suction (via channels 8, for example).

The shoulder region 14, in use, when an article is placed into the holder, guides the article and the stand 3 onto annular seating surface 12. Suction holds the cup rigidly on the holder and a seal is formed between the stand and the seating face 12. However, it is still possible for the cup to be resting non-concentrically when the suction is applied.

The amount of grip is proportional to and limited by three factors: the diameter of the stand where the seal is formed, the area within the seal diameter to which suction is applied and the coefficient of friction between the article and the holder. Other forces applied by the cutting, forming or material application process may also serve to weaken the suction grip.

A holding apparatus 20 according to a first embodiment of the present invention is shown in FIGS. 3 to 5. Similarly to the prior art holder of FIGS. 1 and 2, the holding apparatus 20 of FIGS. 3 to 5 comprises a central region 22 which serves to accommodate the centre of the cup base 2, and any shape, button or protrusion on the cup base 2.

In contrast to the prior art, however, the holding apparatus 20 has an independent outer sleeve 25, which is slidable in an axial direction relative to central region 22. FIG. 3 shows the sleeve in its forward position, in which conical upper edge 24 fully engages and grips inclined portion 4 of drawn cup 1 (best seen from FIG. 4). This is in contrast with the holder of the prior art, which as noted above, is always spaced from the inclined portion 4 (see enlarged section of FIG. 2).

Often the operation such as cutting or forming imparts a torque on the article and is therefore advantageous that the sleeve of the holder of the present invention grips the article 1. Gripping of the article in the present invention is via the sleeve directly on inclined portion 4 of the article and also by a direct seal with a flat seating face 23 at seating diameter D1 of support annulus 26. The grip to face 23 is achieved by a suction channel within this face, is applied to the article via channels 28, and grips the article sufficiently to prevent it from rotating.

As shown in FIGS. 3 and 5, the sleeve 25 is in its uppermost position and is spaced from a rear section by gap "G". Without any suction applied, the sleeve lifts the article away from the holder in this position. In its lowermost position (not shown), the sleeve would not contact the article if the article were placed concentrically on the holder.

FIG. 5 shows a sealing element such as O-ring 29, which prevents unwanted ingress of air between the lower end of the sleeve and the holder and one or more pin(s) 27. Such a sealing element provides a sealing diameter D2 (FIG. 3).

When an article corresponding to the dimensions of the holder and sleeve is positioned on the apparatus and suction is applied, contact between the apparatus and the article forms a seal and the article is pulled against the apparatus by suction. The stand of the article is pulled to the face of the holder and the sleeve is pulled to contact the outer profile of the article at a sealing diameter D3 and at an angle A normal to the axis, so that the article is held concentrically within the apparatus.

Thus, in the embodiment of FIGS. 3 to 5, the apparatus holds the article tightly with forces both at the stand and the outer profile. The axial force $F_S$ at the stand equates to the suction pressure multiplied by the area defined by diameter D2. The axial force $F_P$ at the outer profile equates to the suction pressure multiplied by the area defined between D3 and D2. The resistance to torque provided at the stand is proportional to $F_S$ and additional resistance to torque provided at the outer profile is proportional to $F_P$ divided by cosine A. In the event that the article is pulled away from the seating face of a holder, the forces applied by the sleeve will increase to resist slippage and restore seating.

A second embodiment of the invention is shown in FIGS. 6 to 8. In this embodiment, the outer sleeve is able to slide to a position, which is level with or below the seating face of the holder. This enables the article to be slid easily into position. Applying suction will raise the outer sleeve into contact with the article to be held, and applying compressed air will lower the outer sleeve to allow the article to be slid into or away from the holder.

REFERENCE SIGNS LIST

1 drawn cup
2 cup base
3 stand
4 inclined cup portion
5 prior art holder/holding apparatus
7 central region
8 channels
10 sectioned region of holder
11 support annulus
12 seating face
14 (conical) shoulder region
20 holding apparatus $1^{st}$ embodiment
22 central region
23 seating face
24 conical upper edge
25 outer sleeve
26 support annulus
28 channels
29 'O' ring
30 holding apparatus $2^{nd}$ embodiment
33 seating face
35 outer sleeve

The invention claimed is:

1. An apparatus for holding a container or cup-shaped article, the article having a stand, an inclined surface disposed radially outwardly in relation to the stand, a sidewall, and a rim, the apparatus comprising:

a holder including a seating face configured to contact the stand of the article, and one or more channels for supplying, removing or balancing air pressure such that when suction is applied to the article, the stand is held against the seating face; and a concentric outer sleeve having a guide profile for guiding the article into the holder, the guide profile configured to provide additional contact with the article radially outside the seating face, the guide profile that is configured to contact the inclined surface of the article, to provide the additional radial contact, and to resist lateral movement of the article whilst maintaining concentricity, the outer sleeve being axially moveable from an extended position in which the outer sleeve contacts an outer profile of the article and holds the article concentrically while an operation is performed on the sidewall or rim of the article, the outer sleeve being automatically raised into the extended position by the suction being applied to the article, and a retracted position in which the suction is released and the outer sleeve is spaced apart from the outer profile of the article for release of the article from the seating face after the operation is performed.

2. An apparatus according to claim 1 in which the outer sleeve includes a device to prevent rotation.

3. An apparatus according to claim 2, wherein the outer sleeve includes a gripping device having one or more pin(s).

4. An apparatus according to claim 1, further comprising channels that interconnect from the center of the holding apparatus to regions between the seating face and the outer sleeve.

5. An apparatus according claim 1, further comprising an orifice plate which regulates the flow of air to or from the holder when no article is present to be held.

6. An apparatus according to claim 1, wherein the article is a metal can body.

7. An apparatus according to claim 1, wherein the outer sleeve contacts the outer profile of the article and holds the article concentrically while a cutting or forming operation is performed on the sidewall or rim of the article.

8. An apparatus according to claim 1, wherein the outer sleeve contacts the outer profile of the article and holds the article concentrically while an operation of applying a coating, decoration, or lining is performed on the sidewall or rim of the article.

9. An apparatus according to claim 1, wherein the outer sleeve is in the retracted position when compressed air is applied to the article.

10. A method of holding a cup-shaped article in a concentric position, the article having a stand, an inclined surface disposed radially outwardly in relation to the stand, a sidewall, and a rim, the method comprising the steps of:

supplying, removing or balancing air pressure such that when suction is applied to the article, the stand of the article is held against a seating face of a holder; and contacting the inclined surface of the article with a concentric outer sleeve, the outer sleeve preventing radial movement of the article and maintaining concentricity of the article;

during the step of contacting the inclined surface of the article, performing an operation on the sidewall or rim of the article; and after the step of performing the operation, moving the outer sleeve into a retracted position and releasing the article from the seating face.

11. A method according to claim 10 comprising balancing pressure difference between both sides of the article.

12. A method according to claim 10, wherein the supplying, removing or balancing step comprises supplying compressed air to aid release of the article from the seating face.

13. A method according to claim 10, wherein the supplying, removing or balancing step comprises regulating the flow of air to or from the holder when no article is present.

14. A method according to claim 10, wherein the article is a metal can body.

15. A method of claim 10, wherein the step of performing the operation includes cutting or forming the sidewall or rim of the article.

16. A method of claim 10, wherein the step of performing the operation includes applying a coating, decoration, or lining to the sidewall or rim of the article.

* * * * *